US010761484B2

(12) United States Patent
Christan et al.

(10) Patent No.: US 10,761,484 B2
(45) Date of Patent: Sep. 1, 2020

(54) BALANCE-SPRING STUD-HOLDER FOR A MECHANICAL TIMEPIECE MOVEMENT

(71) Applicant: ETA SA Manufacture Horlogere Suisse, Grenchen (CH)

(72) Inventors: Julien Christan, Bienne (CH); Thierry Conus, Lengnau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 238 days.

(21) Appl. No.: 16/052,801

(22) Filed: Aug. 2, 2018

(65) Prior Publication Data

US 2019/0064739 A1 Feb. 28, 2019

(30) Foreign Application Priority Data

Aug. 31, 2017 (EP) ..... 17188811

(51) Int. Cl.
*G04B 18/06* (2006.01)
*G04B 17/06* (2006.01)
*G04B 17/32* (2006.01)

(52) U.S. Cl.
CPC ..... *G04B 18/06* (2013.01); *G04B 17/063* (2013.01); *G04B 17/325* (2013.01)

(58) Field of Classification Search
CPC ..... G04B 17/32; G04B 17/325; G04B 17/06; G04B 17/063; G04B 18/06
See application file for complete search history.

(56) References Cited

U.S. PATENT DOCUMENTS

| | | | | |
|---|---|---|---|---|
| 3,046,725 | A * | 7/1962 | Vuilleumier | G04B 18/06 368/178 |
| 8,696,195 | B2 * | 4/2014 | Gonthier | G04B 18/026 368/170 |
| 9,122,246 | B2 * | 9/2015 | Capt | G04B 17/325 |
| 9,176,475 | B2 * | 11/2015 | Courvoisier | G04B 18/06 |
| 10,126,712 | B2 * | 11/2018 | Strahm | G04B 17/32 |
| 10,180,659 | B2 * | 1/2019 | Wiederrecht | G04B 18/06 |
| 2012/0176869 | A1 * | 7/2012 | Gonthier | G04B 18/026 368/175 |
| 2015/0138934 | A1 * | 5/2015 | Courvoisier | G04B 17/325 368/178 |

(Continued)

FOREIGN PATENT DOCUMENTS

| | | |
|---|---|---|
| CH | 710 491 A2 | 6/2016 |
| JP | 52-23564 U | 2/1977 |

OTHER PUBLICATIONS

Notch—dictionary.com May 14, 2020.*

(Continued)

*Primary Examiner* — Sean Kayes
(74) *Attorney, Agent, or Firm* — Oblon, McClelland, Maier & Neustadt, L.L.P.

(57) ABSTRACT

The invention relates to a balance-spring stud-holder for a mechanical timepiece movement, which comprises a pair of tabs, namely a front tab and a rear tab, jointly defining a notch, the tabs being arranged in such a way that a balance-spring stud can be held in the notch, wherein the rear tab of the balance-spring stud-holder comprises an extension which defines, beyond the notch, a bend forming a retaining abutment for the balance-spring stud after said balance-spring stud has been extracted from the notch.

10 Claims, 7 Drawing Sheets

(56) References Cited

U.S. PATENT DOCUMENTS

| | | | | |
|---|---|---|---|---|
| 2015/0177689 | A1* | 6/2015 | Capt | G04B 15/14 368/178 |
| 2017/0168455 | A1* | 6/2017 | Strahm | G04B 17/325 |
| 2017/0212473 | A1* | 7/2017 | Wiederrecht | G04B 17/325 |

OTHER PUBLICATIONS

European Search Report dated Mar. 2, 2018 in European Application 17188811.8, filed Aug. 31, 2017 (with English Translation of Categories of Cited Documents).

* cited by examiner

BALANCE-SPRING STUD-HOLDER FOR A MECHANICAL TIMEPIECE MOVEMENT

This application claims priority from European patent application No. 17188811.8 filed on Aug. 31, 2017, the entire disclosure of which is hereby incorporated herein by reference.

TECHNICAL FIELD

The invention deals with the field of watchmaking, and more particularly to the field of mechanical watchmaking, where the regulation of the motive energy is supplied by a spring oscillator. The invention relates, more specifically, to a balance-spring stud-holder for a mechanical movement.

TECHNOLOGICAL BACKGROUND

In most mechanical watches, the energy necessary for the rotation of the hands (for example hands indicating minutes and hours) is accumulated then dispensed by a balance-hairspring system, which comprises an inertia flywheel called balance, associated with a spring in the form of a spirally-wound tape, called hairspring.

By an internal end, the hairspring is fixed onto an axis secured in rotation to the balance; by an outer end, the hairspring is fixed onto a balance-spring stud mounted on a balance-spring stud-holder which is itself secured to a fixed bridge (or cock).

Traditionally, the hairspring is made from a steel alloy based on cobalt, nickel and chrome. A quenching and an annealing are commonly applied to this alloy, which has the advantage of conferring upon it a high limit of elasticity and therefore a good breaking strength. Another advantage of the steel is its suitability for repair. However, a drawback of the steel is its magnetizable nature, which is detrimental to behaviour under load (and therefore to the accuracy of the timepiece movement); in addition, the fixing of the balance-spring stud by gluing is difficult on steel.

It is also known practice (although less commonplace) to use, for the production of the hairspring, silicon. According to Vermot et al (*Traité de Construction Horlogère*, Presses Techniques et Universitaires Romandes, 2014, pp. 712-713), silicon has the advantage of exhibiting a low moment of inertia, a low expansion coefficient, a good corrosion resistance and of being amagnetic. In addition, it is possible to fix the balance-spring stud at the outer end of the silicon spring by means of a two-component glue activated by ultraviolet radiation, which offers a very high fixing power. However, the main drawback with silicon is its breakable nature, in the conditions described hereinbelow.

The rotation of the balance is maintained—and its oscillations counted—by an escapement mechanism comprising a pallet assembly driven by an oscillating movement of low amplitude, provided with two pallets which drive the teeth of an escapement wheel. Thus driven, the escapement wheel has imposed on it a stepwise rotational movement whose frequency is determined by the frequency of oscillation of the pallet assembly, which is itself locked onto the frequency of oscillation of the balance (that is to say of the hairspring).

In a traditional escapement mechanism, the frequency of oscillation is approximately 4 Hz, or approximately 28 800 alternations per hour (Ah). One objective of the good watchmakers is to ensure the isochronism and the regularity of the oscillations (or constancy of the rate) of the balance.

It is known practice to set the rate of the balance by adjusting the active length of the hairspring, defined as the curvilinear length between its inner end and a counting point, located in the vicinity of the outer end of the hairspring and generally defined by a pair of abutments borne by a key mounted on a regulator.

In operation, this regulator is fixed in rotation relative to the axis of the hairspring. However, it is possible, by a manual intervention, to finely set the angular position thereof, for example by pivoting, by means of a screwdriver, an eccentric acting on the regulator in the way of a cam.

The assembly comprising the bridge, the regulator, the key, the balance-spring stud-holder, the balance-spring stud, the axis, the spring and the balance, is commonly called "adjustment mechanism". Examples of adjustment mechanisms are proposed by the international application WO 2016/192957 and by the European patent EP 2 876 504, both in the name of timepiece manufacturer ETA.

Some interventions on the adjustment mechanism can require the unwinding (even the complete dismantling) of the hairspring. The balance-spring stud, secured to the outer end of the hairspring, then has to be separated from the balance-spring stud-holder.

This operation, called de-pegging, is difficult. The watchmaker generally holds the balance-spring stud by means of a pair of tweezers, then delicately removes the balance-spring stud.

However, it often happens that the balance-spring stud escapes from the tweezers, which provokes an abrupt release of the hairspring whose outer end is thus freed.

This incident is inconsequential when the hairspring is made of steel (and more specifically of steel alloy, as indicated above), because the quenching and tempering treatments which are applied to it make it sufficiently ductile to allow for a rewinding of the hairspring.

On the other and, that same incident for a hairspring made of silicon which, statistically, breaks in more than one case in every two, is dramatic.

The objective of the invention is to allow for a de-pegging by limiting, even eliminating, the risk of breaking.

SUMMARY OF THE INVENTION

There is proposed, firstly, a balance-spring stud-holder as defined in Claim 1.

That way, the balance-spring stud extracted from the notch is blocked in the abutment, which prevents the spring (hairspring) from being abruptly relaxed during the de-pegging. The risk of breaking of the spring is thus limited.

Advantageous features of the balance-spring stud-holder, that can be taken alone or according to all technically possible combinations, are defined in the dependent claims.

There is proposed, secondly, an assembly comprising such a balance-spring stud-holder.

Advantageous features of the assembly, that can be taken alone or according to all technically possible combinations, are defined in the dependent claims.

There is proposed, thirdly, a timepiece movement comprising such an assembly.

There is proposed, fourthly, a watch comprising such a mechanical timepiece movement.

BRIEF DESCRIPTION OF THE FIGURES

Other objects and advantages of the invention will become apparent in light of the description of an embodiment, given hereinbelow with reference to the attached drawings in which.

DETAILED DESCRIPTION OF THE INVENTION

Figure 1:
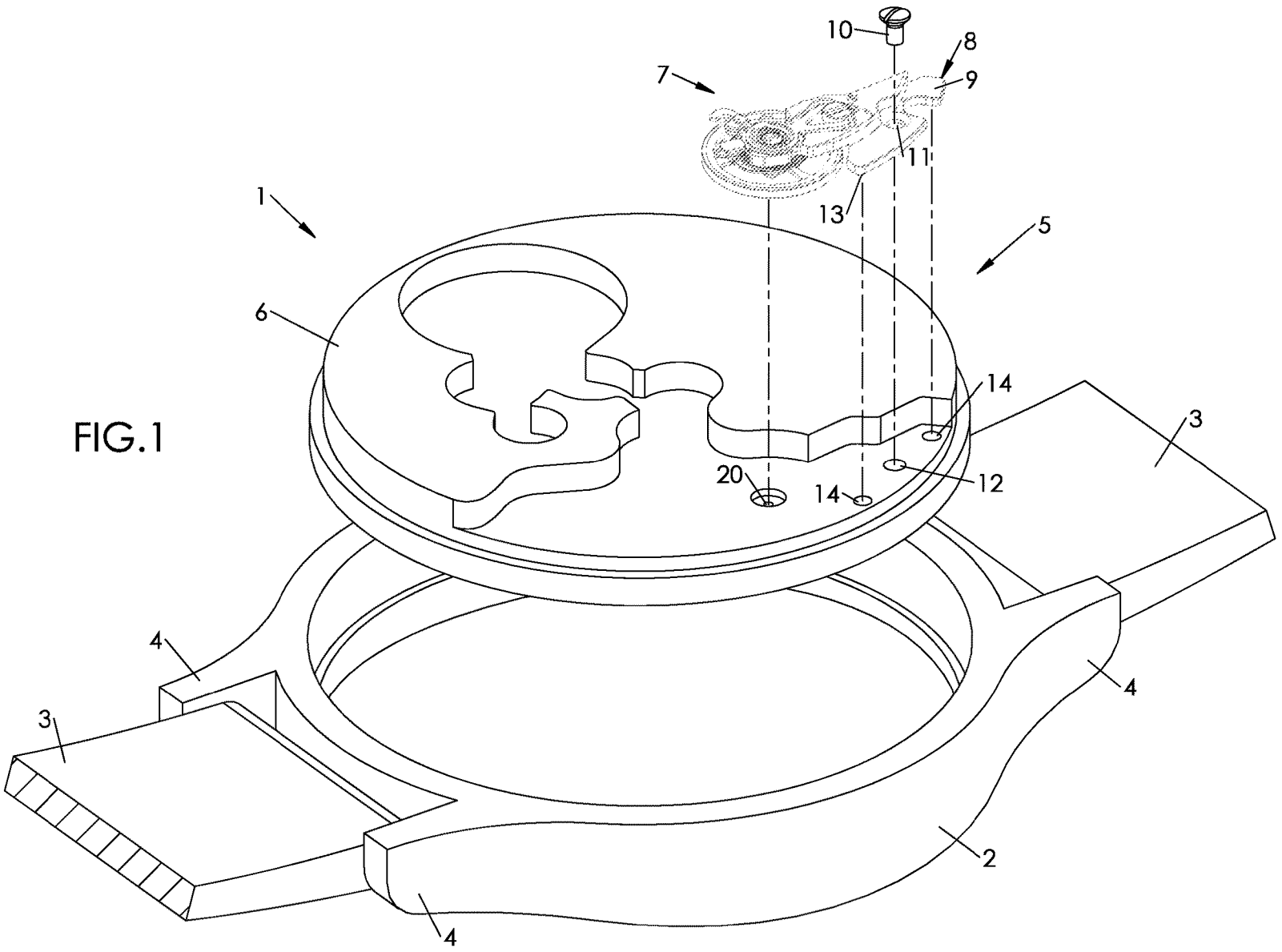
FIG. 1 is an exploded perspective view partially showing a watch comprising a mechanical timepiece movement including an adjustment mechanism.

FIG. 1 shows a watch 1.

This watch 1 comprises a middle 2, which can in particular be made of metal (for example steel), or of a synthetic material (for example, a composite material comprising a polymer matrix filled with fibres, typically of carbon).

The watch 1 also comprises, for wearing on the wrist, a bracelet 3 which is fixed onto the middle 2 between horns 4 formed protruding therefrom.

The watch 1 also comprises a glass and a bottom (not represented), fixed onto the middle 2 on either side thereof.

The watch 1 comprises, finally, a timepiece movement 5, hereinafter simply called "movement", which comprises a mainplate 6 intended to be housed in the middle 2 by being fixed thereto, for example by means of screws. The mainplate 6 forms a support for various mechanisms such as gear-train, adjustment mechanism, escapement, transmission, motion work, winding mechanism (list not exhaustive).

This timepiece movement 5 is mechanical, its motive energy source being supplied by a barrel spring and regulated by a spring oscillator. To protect this oscillator, the movement 5 incorporates an adjustment mechanism 7, which is mounted on the mainplate 6.

The adjustment mechanism 7 comprises, firstly, a bridge 8. This bridge 8, also called "cock", takes the form of a rigid part (which can be metal) fixed onto the mainplate 6. The bridge 8 forms both a support and a guide for the other components of the adjustment mechanism 7.

Figure 3:
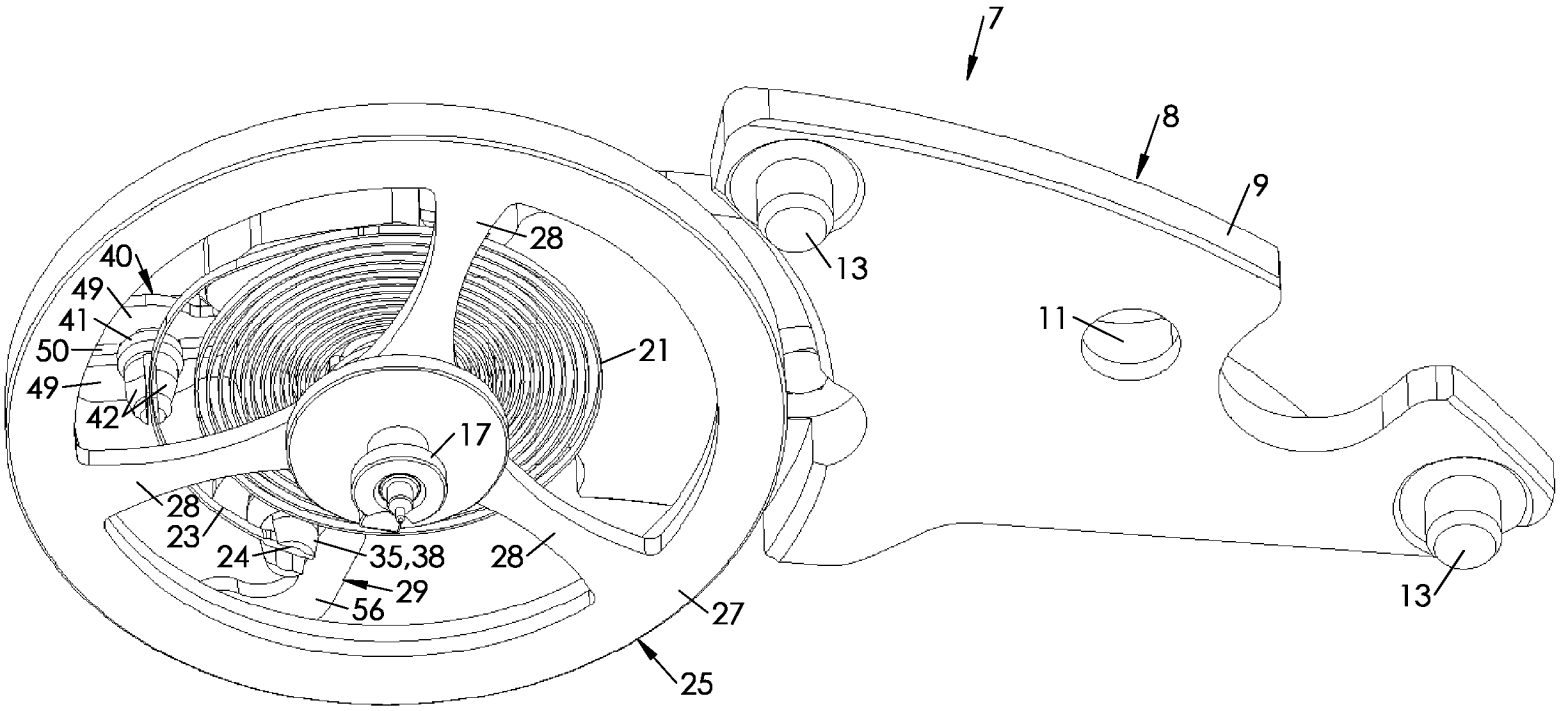
FIG. 3 is a perspective view from below showing the adjustment mechanism.

According to an embodiment illustrated in the drawings, and in particular in FIG. 1 and in FIG. 3, the bridge 8 comprises a base 9. It is by this base 9 that the bridge 8 is fixed onto the mainplate 6 by means of a screw 10 which, passing through a hole 11 formed in the base 9, helically engages with a tapped hole 12 drilled in the mainplate 6.

The accurate positioning of the bridge 8 relative to the mainplate 6 is ensured by means of feet 13 which protrude from an inner face of the base 9 and are fitted into complementary bores 14 formed in the mainplate 6.

For the fixing and the guiding of the other components of the adjustment mechanism 7, the bridge 8 comprises an apron 15, formed of a single piece with the base 9. The bridge 8 is provided with a bore 16 formed in the apron 15, at an overhanging end thereof.

The adjustment mechanism 7 comprises, secondly, a main axis 17, which takes the form of a staged single-piece part mounted to rotate relative to the bridge 8. More specifically, the main axis 17 is mounted to rotate between the mainplate 6 and the bridge 8.

According to a particular embodiment (illustrated in particular in FIG. 4 and FIG. 5), in order to ensure the rotation of the axis 17 relative to the bridge 8, the adjustment mechanism 7 comprises a shock damper 18, driven into the bore 16, and which comprises, on an inner face, a hole 19 for guiding a first end of the main axis 17.

As can also be seen in FIG. 1, the mainplate 6 is provided with a hole 20 for guiding a second end of the main axis 17.

To limit the frictions in the rotation of the main axis 17, the ends thereof advantageously cooperate with a hard mineral, such as ruby or diamond.

The adjustment mechanism 7 comprises, thirdly, a spring 21 spirally wound around the main axis 17. More specifically, the spring 21, hereinafter called "hairspring", has an inner end 22, secured to the axis 17, and an outer turn 23 which is terminated by an outer end 24.

According to an advantageous embodiment, the hairspring 21 is produced in silicon, possibly covered with a layer of oxide.

When it is armed, the hairspring 21 provides a return torque which is exerted on the axis 17.

To increase this torque supplied by the hairspring 21 and the amplitude of its oscillations, the adjustment mechanism 7 comprises, fourthly, an inertia flywheel in the form of a balance 25 secured in rotation to the axis 17.

This balance 25, produced for example in brass, comprises a hub 26, by which it is driven onto the axis 17, a felloe 27, and spokes 28 (here, three, but this number is only illustrative) which link the hub 26 to the felloe 27.

The adjustment mechanism 7 comprises, fifthly, a balance-spring stud-holder 29 which comprises a ring 30, by which it is secured to the bridge 8, and a pair of tabs, namely a front tab 31 and a rear tab 32 (front and rear being defined in the direction of winding of the hairspring 21, from the inner end 22 to the outer end 24) which protrude radially from the ring 30 and, together, define a notch 33.

The balance-spring stud-holder 29 is advantageously produced in a metal material, for example steel.

Figure 4:
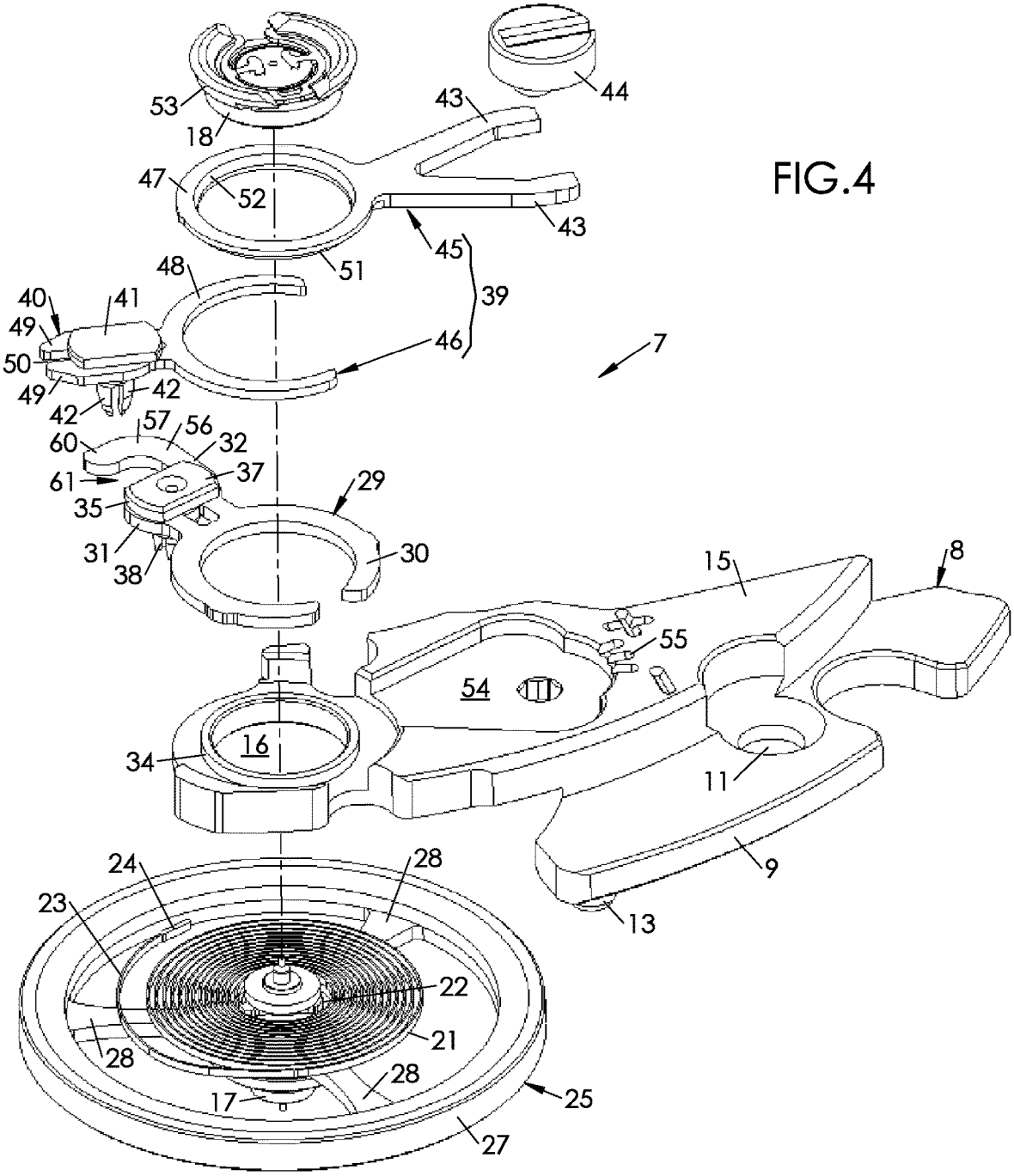
FIG. 4 is an exploded perspective view, from above, of the adjustment mechanism.

According to an embodiment illustrated in FIG. 4, the ring 30 of the balance-spring stud-holder 29 is driven onto a barrel 34 which protrudes from the apron 15 coaxially to the bore 16.

The adjustment mechanism 7 comprises, sixthly, a balance-spring stud 35 secured to the outer end 24 of the hairspring 21. This balance-spring stud 35 is for example produced in steel. According to an embodiment, the balance-spring stud 35 is fixed to the outer end 24 of the hairspring 21 by gluing, by means of a photo-polymerizable glue whose adhesion properties are activated by exposure to a photon radiation in the ultraviolet.

As illustrated in the drawings, and more particularly in FIG. 4, FIG. 5, FIG. 7 and FIG. 8, the balance-spring stud 35 comprises a cylindrical body 36 by which the balance-spring stud 35 is snap-fitted into the notch 33, and, on either side of the body 36:

a widened head 37 by which the balance-spring stud 35 bears against the balance-spring stud-holder 29, a fork 38 in which is housed (by being glued) the outer end 24 of the hairspring 21.

Fixed thus onto the balance-spring stud-holder 29, the balance-spring stud 35 ensures the securing (that is to say the immobilization relative to the bridge 8) of the outer end 24 of the hairspring 21.

The oscillations of the hairspring 21 are maintained (and counted) by an escapement pallet assembly (not represented) which communicates to it a kinetic energy, which arms the hairspring 21 by driving it beyond its position of equilibrium.

In being disarmed, that is to say in tending to return to its position of equilibrium, the hairspring 21 rotationally drives the main axis 17, to which it is secured by its inner end 22, with the balance 25 which is itself secured to the axis 17. Having arrived at a complete relaxation, the hairspring 21 is immobilized (with the axis 17 and the balance 25) then, under the effect of its elasticity, tends to be compressed once again and then drives the axis 17 and the balance 25 in a rotation in the reverse direction.

The oscillations of the hairspring 21—balance 17 system serve to regulate the alternating switchover movements of the escapement pallet assembly, which is provided with a pair of pallets alternately driving an escapement wheel whose stepwise rotation, at a frequency determined by the oscillations of the pallet assembly (that is to say of the spring), is transmitted to a motion work provided with one (or more) hand(s) indicating hours (and/or minutes).

The frequency of the oscillations of the hairspring 21—balance 17 system can be finely regulated, by hand, by an intervention on the adjustment mechanism 7, which, to this end, comprises, seventhly, a regulator 39.

The regulator 39 is fixed to the bridge 8 with the possibility of angular travel relative thereto about the main axis 17.

More specifically, the regulator 39 comprises:

a tail 40 bearing a key 41 which defines a pair of abutments 42 arranged on either side of the outer turn 23 of the hairspring 21, and at least one indexing finger 43 which cooperates with an eccentric 44, mounted on the bridge 8 to adjust the angular position of the regulator 39 by rotation of the eccentric 44.

Figure 5:
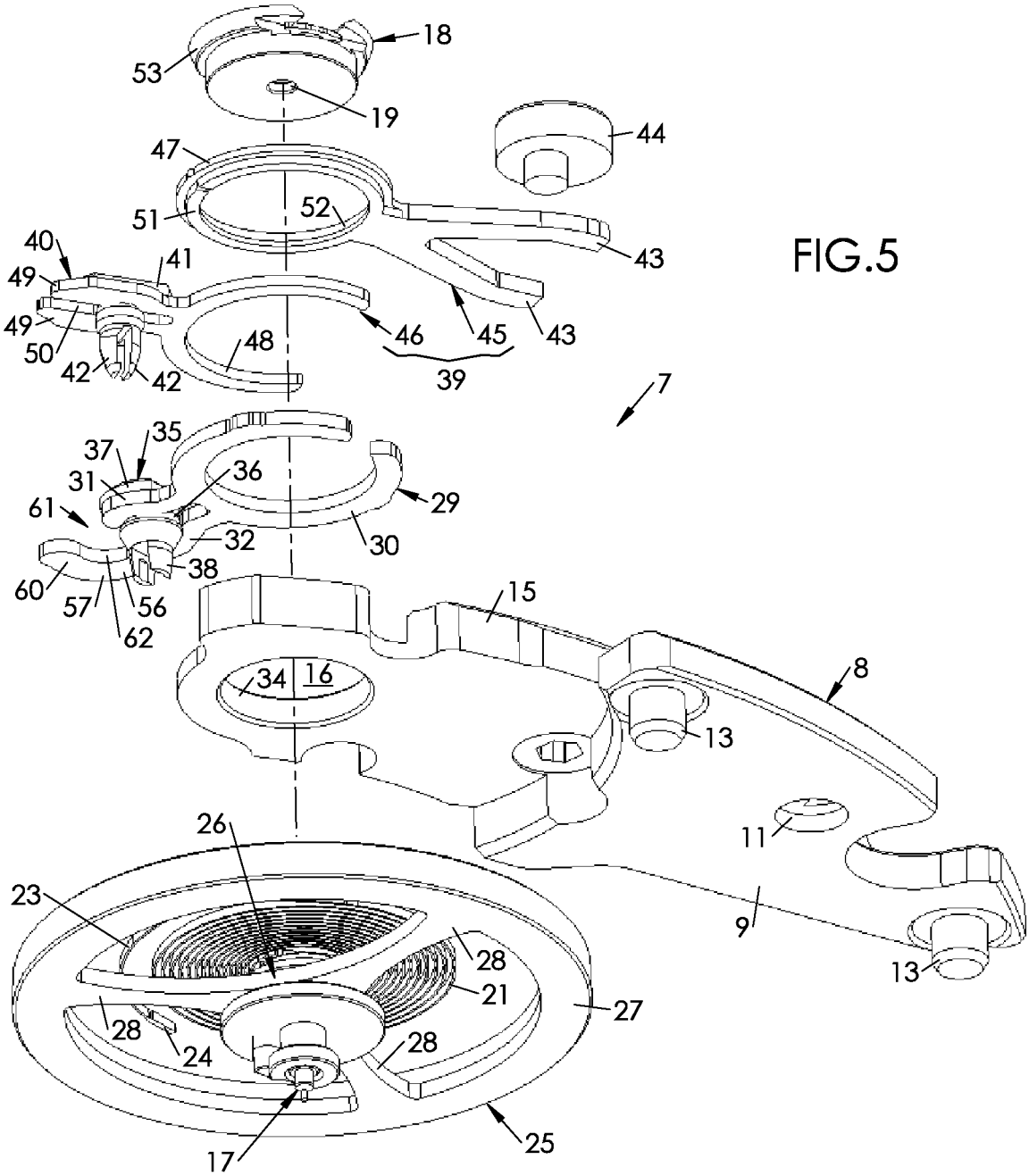
FIG. 5 is an exploded perspective view, from below, of the adjustment mechanism.

According to a preferred embodiment illustrated in particular in FIG. 4 and FIG. 5, the regulator 39 comprises two distinct secured elements, namely:

an upper regulator element 45, which bears the indexing finger 43;

a lower regulator element 46, which bears the tail 40.

In the example illustrated, the upper element 45 comprises a central ring 47 and a pair of indexing fingers 43 which extend radially in a V from this central ring 47.

In this same example, the lower element 46 comprises a ring 48; the tail 40 comprises a pair of tongues 49 which protrude radially from the ring 48 and define between them a slit 50 into which the key 41 is inserted.

The central ring 47 of the upper element 45 comprises a protruding bush 51 driven into the ring 48 of the lower element, which secures the upper element 45 and the lower element 46.

Moreover, the central ring 47 of the upper element 45 is provided with a chamfer 52 complementing a tapered reach 53 formed on the shock damper 18, which ensures the rotational guiding of the regulator 39 about the axis 17.

The abutments 42 together form, for the hairspring 21, a counting point, which, with the inner end 22, defines an active (curvilinear) length on which the frequency of the oscillations of the hairspring 21 depends. The (manual) rotation of the eccentric 44 varies the angular position of the regulator 39 and therefore of the counting point, which increases (or, on the other hand, reduces) the active length (and therefore the frequency of the oscillations) of the hairspring 21.

Figure 2:
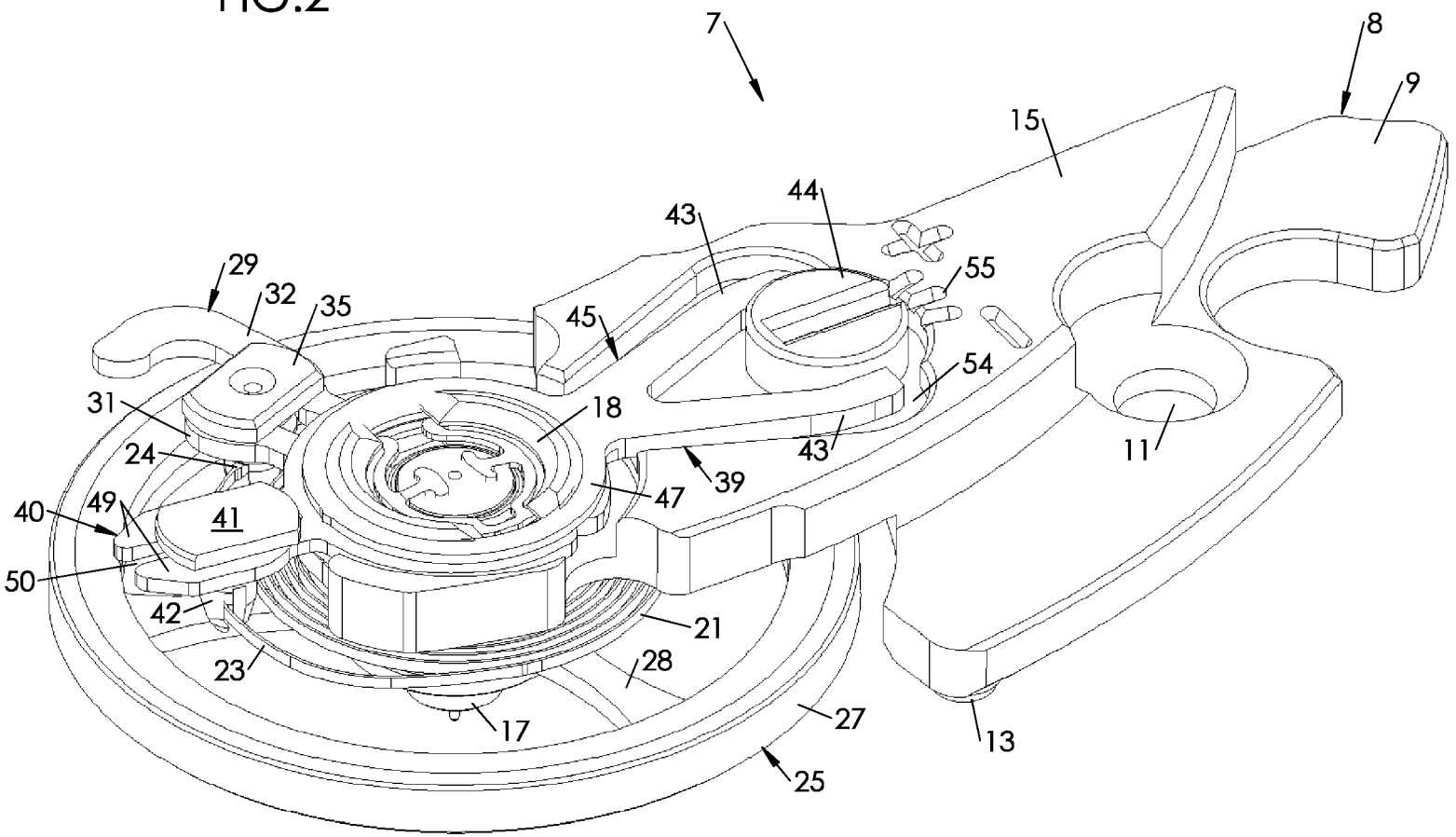
FIG. 2 is a perspective view from above showing the adjustment mechanism on its own.

According to an embodiment illustrated in FIG. 2 and FIG. 4, the finger (fingers) is (are) housed in a hollowed-out reserve 54 formed in the apron 15 of the bridge 8. A regulation 55, and "–" and "+" signs, etched into the apron 15, provide the watchmaker with indications as to the scale and the direction of rotation, useful to allow him or her to finely adjust (with eyepiece or microscope, or even by means of a specific apparatus, such as the REGO model marketed by the company CENTAGORA) the position of the eccentric 44 (notched to this end)—and therefore of the regulator 39.

During manual interventions on the adjustment mechanism 7, the de-pegging, that is to say the removal of the balance-spring stud 35 from the balance-spring stud-holder 29, may be necessary. To avoid having the balance-spring stud 35 released from the balance-spring stud-holder 29 being thrown far away under the effect of an abrupt relaxation of the hairspring 21, the balance-spring stud-holder 29 is provided with a retaining abutment for the balance-spring stud 35 extracted from the notch 33.

More specifically, the rear tab 32 of the balance-spring stud-holder 29 comprises an extension 56 which defines, beyond the notch 33, a bend 57 forming this abutment.

Thus, the rear tab 32 comprises, in a single piece:

a lower section 58, which, with the front tab 31, defines the notch 33, the extension 56, which extends radially in the continuity of the lower section 58.

Figure 6:
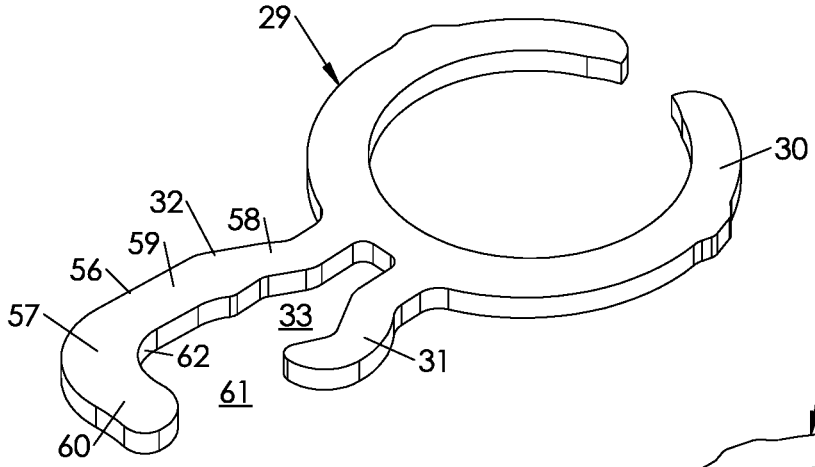
FIG. 6 is a perspective view of the balance-spring stud-holder with which the adjustment mechanism of the preceding figures is equipped.
Figure 9:
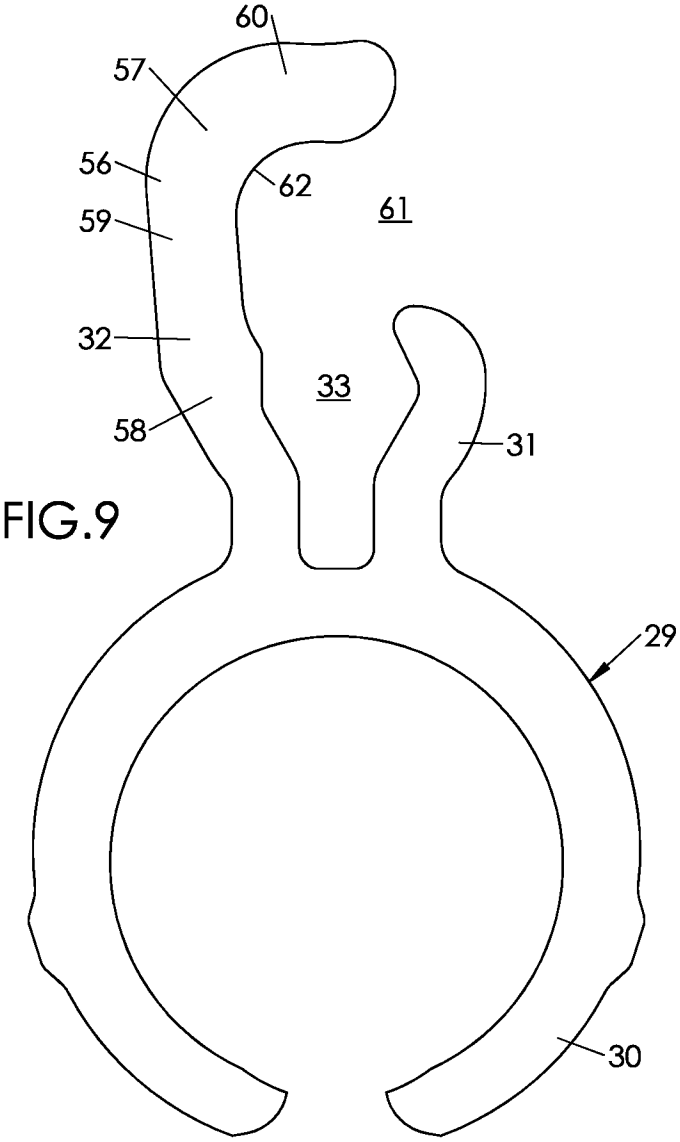
FIG. 9 is a view from below of the balance-spring stud-holder alone.

According to an embodiment illustrated in the drawings, and more particularly in FIG. 6 and FIG. 9, the extension 56 comprises a radial portion 59 (substantially collinear with the inner section 58), and a transverse portion 60 which extends the radial portion 59 in the way of a bracket.

The bend 57 is defined at the junction between the radial portion 59 and the transverse portion 60.

As can be clearly seen in FIG. 9, the transverse portion 60 of the extension 56 is advantageously spaced apart from the front tab 31 to form with it a fairly wide passage 61 to allow the introduction (or the forced removal) of the balance-spring stud 35, transversely.

The rear tab 32 preferentially has an inner connection hollow 62 at the level of the bend 57.

Figure 7:
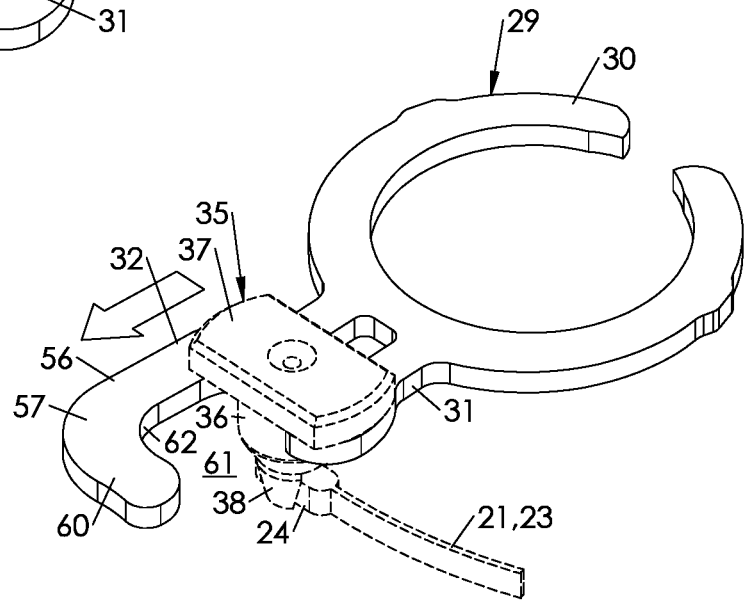
FIG. 7 is a partial perspective view showing the balance-spring stud-holder, the balance-spring stud (in dotted lines) mounted on the balance-spring stud-holder, and a part of the outer strand of the spring (also in dotted lines)
Figure 8:
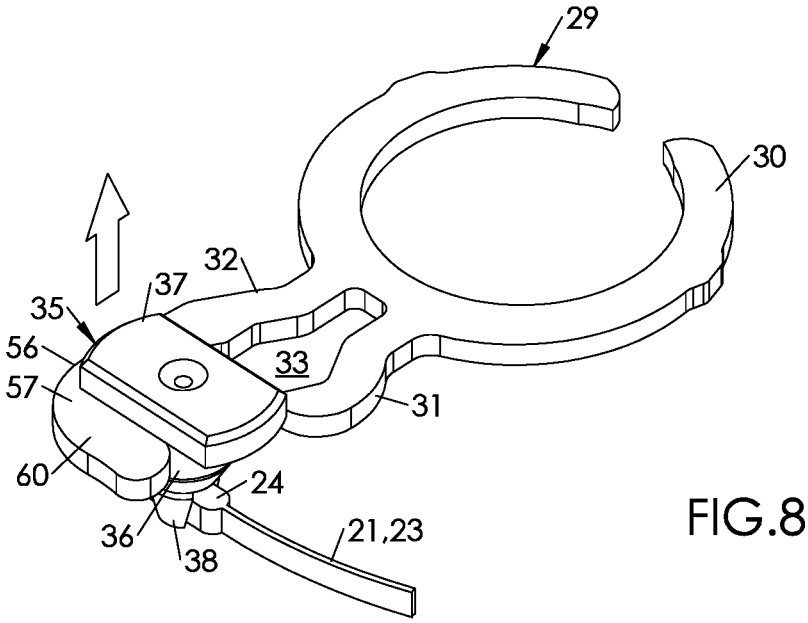
FIG. 8 is a perspective view similar to FIG. 7, showing the balance-spring stud-holder with the balance-spring stud extracted from the notch and in abutment against the bend.
Figure 10:
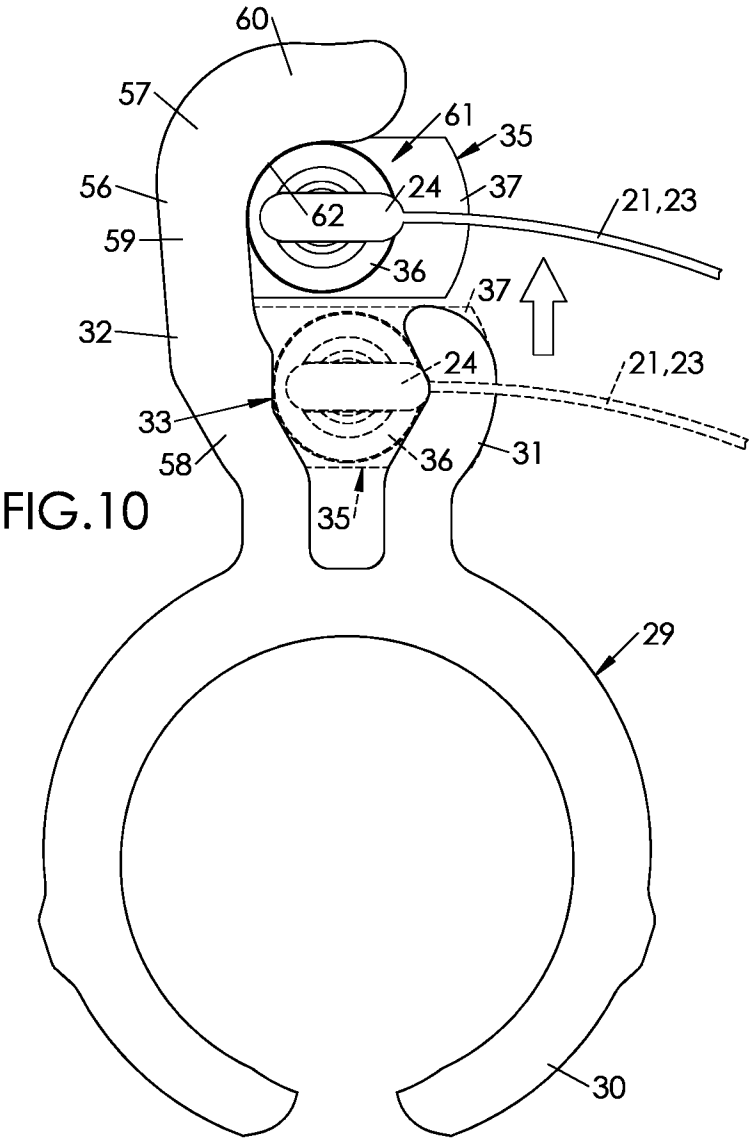
FIG. 10 is a view from below of the balance-spring stud-holder with, in dotted lines, the balance-spring stud snap-fitted into the notch and, in solid lines, the balance-spring stud extracted from the notch, in abutment against the bend.

The balance-spring stud 35 snap-fitted into the notch 33 is illustrated by dotted lines in FIG. 7 and in FIG. 10. In this position, the body 36 of the balance-spring stud 35 cooperates with the facets of the notch 33 which thus ensures the retaining thereof for the purposes of standard operation of the hairspring 21 (and therefore of the movement 5).

The balance-spring stud 35 is extracted (that is to say unsnap-fitted) from the notch 33 manually, by an outward radial movement (that is to say tending to separate the balance-spring stud 35 from the ring 30), in the direction indicated by the arrows in FIG. 7 and FIG. 10. Now, the position of equilibrium of the hairspring 21 is reached when the balance-spring stud 35 is in the notch 33 of the balance-spring stud-holder. During the manual intervention, the balance-spring stud therefore has a tendency to return thereto, and thus to be blocked in the bend 57 (and more specifically in the hollow 62) where it is thus retained, as illustrated in solid lines in FIG. 8 and FIG. 10.

The bend 57 (and therefore the abutment that it forms) makes it possible to unsnap-fit the balance-spring stud 35 without risking having it escape when it is removed from the notch 31.

It is then possible to modify the seizure of the balance-spring stud 7 to ensure a firmer holding thereof and then completely disengage it from the balance-spring stud-holder 29, for example in order to dismantle the hairspring 21.

Since the balance-spring stud 35 is then retained by the abutment formed by the bend 57, it is possible to then change tool to ensure a more comfortable (and firmer) grasp of the balance-spring stud 35 (for example by means of a pair of tweezers) in order, for example, to completely dismantle the hairspring 21, by a vertical movement, as illustrated by the arrow in FIG. 10. In other words, the de-pegging is performed in two stages.

The result thereof is a reduced, even eliminated, risk of breakage of the hairspring 21 in the de-pegging, to the benefit of the reliability of the adjustment mechanism 7.

What is claimed is:

1. A balance-spring stud-holder for a mechanical timepiece movement, which comprises a pair of tabs, namely a front tab and a rear tab, jointly defining a notch, the tabs being arranged in such a way that a balance-spring stud can be held in the notch, Wherein the rear tab of the balance-spring stud-holder comprises an extension which defines, beyond the notch, a bend forming a retaining abutment for the balance-spring stud after said balance-spring stud is extracted from the notch.

2. The balance-spring stud-holder according to claim 1, wherein the rear tab comprises an inner section which, with the front tab, defines the notch, said extension comprising a radial portion, substantially collinear with the inner section, and a transverse portion which squarely extends the radial portion, the bend being defined at the junction between the radial portion and the transverse portion.

3. The balance-spring stud-holder according to claim 2, wherein the transverse portion of the extension is spaced apart from the front tab to form therewith a transverse passage for the balance-spring stud.

4. The balance-spring stud-holder according to claim 2, wherein the rear tab has an inner connection hollow at the level of the bend.

5. An assembly for a mechanical timepiece movement, comprising a balance-spring stud-holder according to claim 1 and a balance-spring stud, wherein the balance-spring stud has a cylindrical body by which it is snap-fitted into the notch, and, on either side of the body:

a widened head by which the balance-spring stud bears against the balance-spring stud-holder, a fork into which an outer end of a spring of the movement is intended to be housed.

6. The assembly according to claim 5, further comprising a regulator which comprises two distinct secured elements, namely:

an upper regulator element, which forms a pair of indexing fingers making it possible to adjust the angular position of the regulator;

a lower regulator element, which forms a tail.

7. The assembly according to claim 6, wherein the upper element comprises a central ring, the pair of indexing fingers extending in a V from this central ring.

8. The assembly according to claim 6, wherein the tail comprises a pair of tongues which define between them a slit allowing the insertion of a key.

9. A mechanical timepiece movement, which incorporates an assembly according to claim 5.

10. A watch comprising a mechanical timepiece movement according to claim 9.

* * * * *